US005232391A

United States Patent [19]

Vaughns et al.

[11] Patent Number: 5,232,391

[45] Date of Patent: Aug. 3, 1993

[54] AERODYNAMIC TOY APPARATUS MANIPULATED FROM THE INTERIOR OF A MOTOR VEHICLE

[76] Inventors: Ronald E. Vaughns, 15503 Summer Briar Ct.; Gary L. Glazebrook, Sr., 6506 Summer Ridge, both of Missouri City, Tex. 77489

[21] Appl. No.: 901,959

[22] Filed: Jun. 22, 1992

[51] Int. Cl.[5] ..... A63H 27/00; A63H 21/02; A63H 33/40; A63H 27/04

[52] U.S. Cl. ..... 446/230; 446/228; 446/217; 446/30

[58] Field of Search ..... 446/230, 231, 232, 228, 446/236, 217, 218, 177, 176, 30, 31, 32, 429, 490

[56] References Cited

U.S. PATENT DOCUMENTS

| | | | |
|---|---|---|---|
| 2,921,405 | 1/1960 | Perkins | 446/30 |
| 3,318,042 | 5/1967 | Wolf | 446/31 |
| 3,696,822 | 10/1972 | Mace | 446/30 |
| 4,216,613 | 8/1980 | Livick | 446/231 |
| 4,418,495 | 12/1983 | Kennedy et al. | 446/429 |
| 4,619,626 | 10/1986 | Tarulli | 446/228 |
| 4,728,311 | 1/1988 | Magers | 446/232 X |
| 4,900,286 | 2/1990 | Buffalo | 446/30 |

FOREIGN PATENT DOCUMENTS 1139949 1/1983 Canada ..... 446/429

OTHER PUBLICATIONS

"Car Plane", Playthings, vol. 62, Jul. 1964, p. 123.

*Primary Examiner*—Robert A. Hafer
*Assistant Examiner*—D. Neal Muir
*Attorney, Agent, or Firm*—Kenneth A. Roddy

[57] ABSTRACT

An aerodynamic toy apparatus is mounted at one end on the side window of a motor vehicle and is manually manipulated from within the vehicle by a passenger in the back seat. A generally rectangular support member is configured at one end to be received on the window glass and has an aerodynamically shaped cup-like shroud portion at the opposed end positioned outwardly a distance from the vehicle. A retractable toy member connected to a pivot arm on the interior of the shroud is movable from a retracted position to an extended position to be acted upon by air currents as the vehicle moves and is manually manipulated by cables from the vehicle interior to simulate flying and other movements.

18 Claims, 4 Drawing Sheets

AERODYNAMIC TOY APPARATUS MANIPULATED FROM THE INTERIOR OF A MOTOR VEHICLE

BACKGROUND OF THE INVENTION

1. Field of the Invention

This invention relates generally to aerodynamically driven toys, and more particularly to an aerodynamic toy apparatus mounted on a motor vehicle and manually manipulated from the vehicle interior.

2. Brief Description of the Prior Art

Aerodynamically driven toys and movable ornaments attached to vehicles are known in the art. There are several patents which disclose various wind driven toys which may be attached to motor vehicles, none of which are manipulated from within the vehicle.

Bott, U.S. Pat. No. 1,794,576 discloses a folded toy airplane secured to a stem or rod and has a propeller which spins.

Wilson, U.S. Pat. No. 1,824,003 discloses a toy airplane secured to a telescopic rod which is mounted on a motor vehicle and will rise and fall as the vehicle moves and increases or decreases speed.

Kupperman et al, U.S. Pat. No. 4,094,091 discloses a plastic spinner which can be mounted on a wheeled vehicle, such as a bicycle.

Greider, U.S. Pat. No. 4,114,308 discloses an aerodynamically driven toy which can be mounted on a wheeled vehicle, such as a bicycle, and has a moving appendage driven aerodynamically when passing through a relative wind to create a flapping movement, such as the wing of a bird.

The present invention is distinguished over the prior art in general, and these patents in particular by an aerodynamic toy apparatus which is mounted at one end on the side window of a motor vehicle and is manually manipulated from within the vehicle by a passenger in the back seat. A generally rectangular support member is configured at one end to be received on the window glass and has an aerodynamically shaped cup-like shroud portion at the opposed end positioned outwardly a distance from the vehicle. A retractable toy member connected to a pivot arm on the interior of the shroud is movable from a retracted position to an extended position to be acted upon by air currents as the vehicle moves and is manually manipulated by cables from the vehicle interior to simulate flying and other movements.

SUMMARY OF THE INVENTION

It is therefore an object of the present invention to provide an aerodynamic toy apparatus capable of being mounted on a motor vehicle and manually manipulated from the vehicle interior.

It is another object of this invention to provide an aerodynamic toy apparatus mounted on a motor vehicle and having a retractable toy member exterior of the vehicle which is movable from a retracted position to an extended position and manually manipulated from the vehicle interior to be acted upon by air currents as the vehicle moves.

Another object of this invention is to provide an aerodynamic toy apparatus mounted on a motor vehicle and having a retractable toy member exterior of the vehicle which is movable from a retracted position to an extended position and manually manipulated by cables from the vehicle interior to simulate flying movements.

A further object of this invention is to provide an aerodynamic toy apparatus mounted on a motor vehicle and having a retractable toy member exterior of the vehicle which is manually manipulated by a passenger in the rear seat for amusement.

A still further object of this invention is to provide an aerodynamic toy apparatus which is simple in construction, and economical to manufacture.

Other objects of the invention will become apparent from time to time throughout the specification and claims as hereinafter related.

The above noted objects and other objects of the invention are accomplished by an aerodynamic toy apparatus which is mounted at one end on the side window of a motor vehicle and is manually manipulated from within the vehicle by a passenger in the back seat. A generally rectangular support member is configured at one end to be received on the window glass and has an aerodynamically shaped cup-like shroud portion at the opposed end positioned outwardly a distance from the vehicle. A retractable toy member connected to a pivot arm on the interior of the shroud is movable from a retracted position to an extended position to be acted upon by air currents as the vehicle moves and is manually manipulated by cables from the vehicle interior to simulate flying and other movements.

DESCRIPTION OF THE PREFERRED EMBODIMENT

Figures 1, 2:
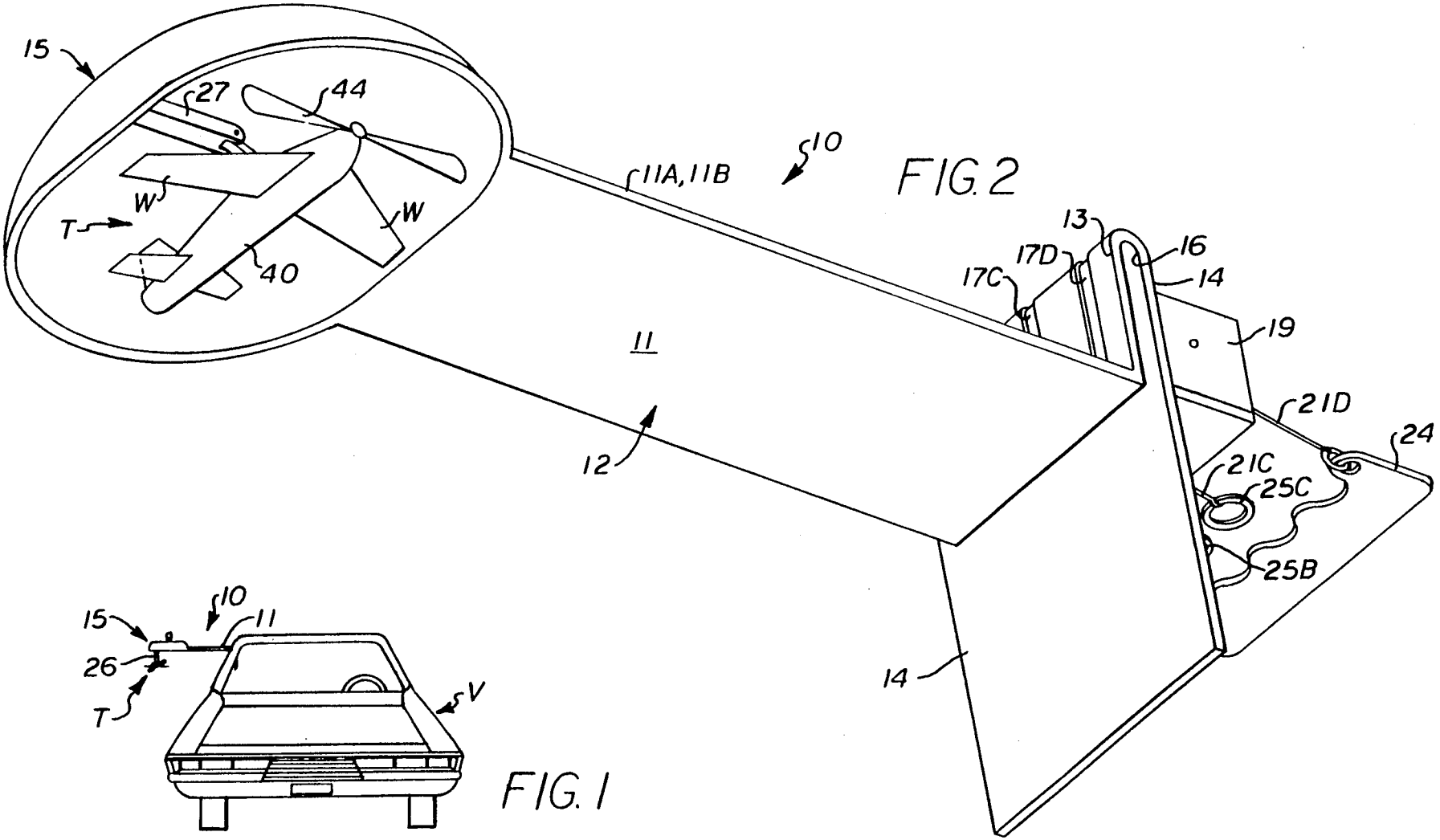
FIG. 1 is a front view of a motor vehicle having an aerodynamic toy apparatus in accordance with the present invention mounted thereon.
FIG. 2 is an isometric view of the aerodynamic toy apparatus shown from the bottom in a retracted position.
Figure 3:
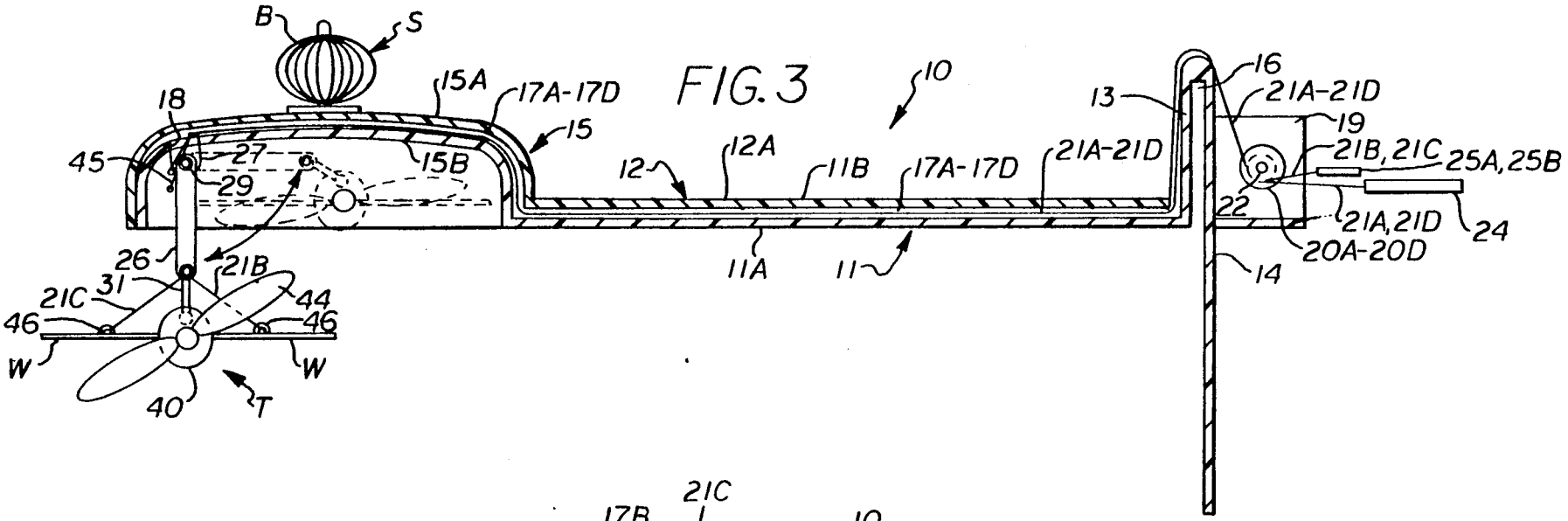
FIG. 3 is a front plan view in partial cross section of the aerodynamic toy apparatus showing the manual manipulating apparatus.
Figure 4:
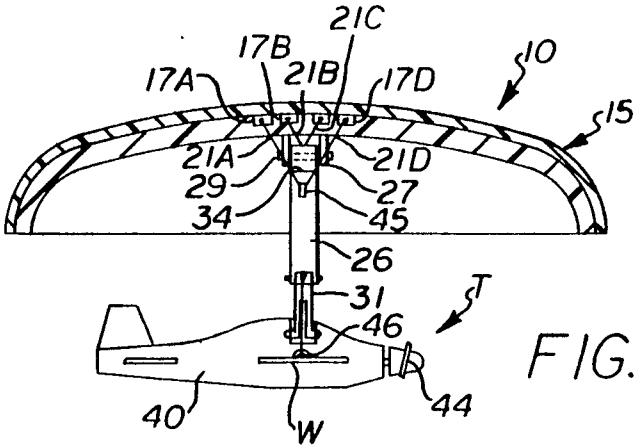
FIG. 4 is an isometric view of a portion of the support member showing one embodiment of a cable guide arrangement for the manual manipulating apparatus.

Referring to the drawings by numerals of reference, there is shown in FIG. 1, a motor vehicle V having an aerodynamic toy apparatus 10 in accordance with the present invention mounted thereon. The toy 10 is movably connected at one end of a support member 11 which is mounted at its other end on the rear side window of the vehicle and is manually manipulated from within the vehicle by a passenger in the back seat.

Referring additionally to FIGS. 2–6, the support member 11 of the aerodynamic toy apparatus 10 is a generally rectangular member 11 having flat horizontal portion 12 with a first and second upwardly extending vertical portion 13 and 14, respectively, at one end and an aerodynamically shaped cup-like shroud portion 15 at the opposed end. The second vertical portion 13 extends downward beyond the horizontal portion 12 and is spaced parallel to the first vertical portion to define a slot 16 therebetween of sufficient width to receive the roll-up window glass of the vehicle.

Figure 5:
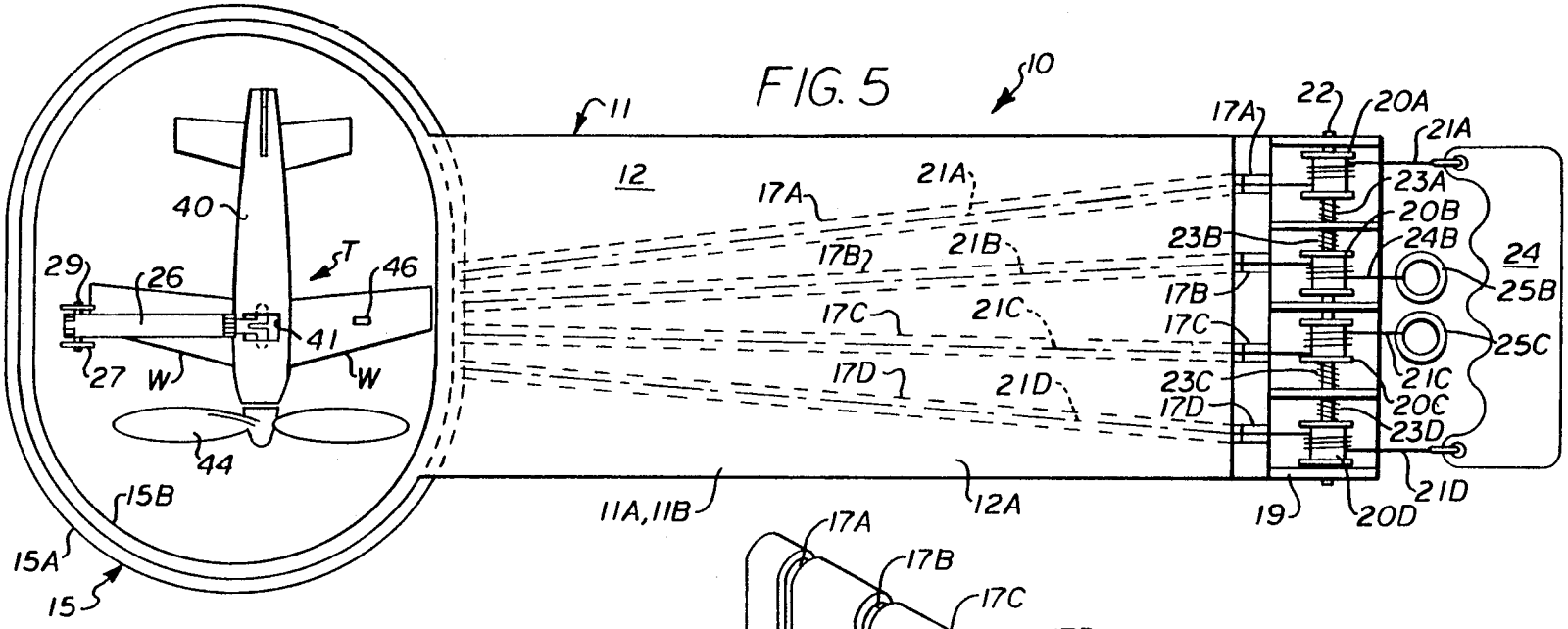
FIG. 5 is a top view through the support member showing the cable arrangement and manual manipulating apparatus.
Figure 6:
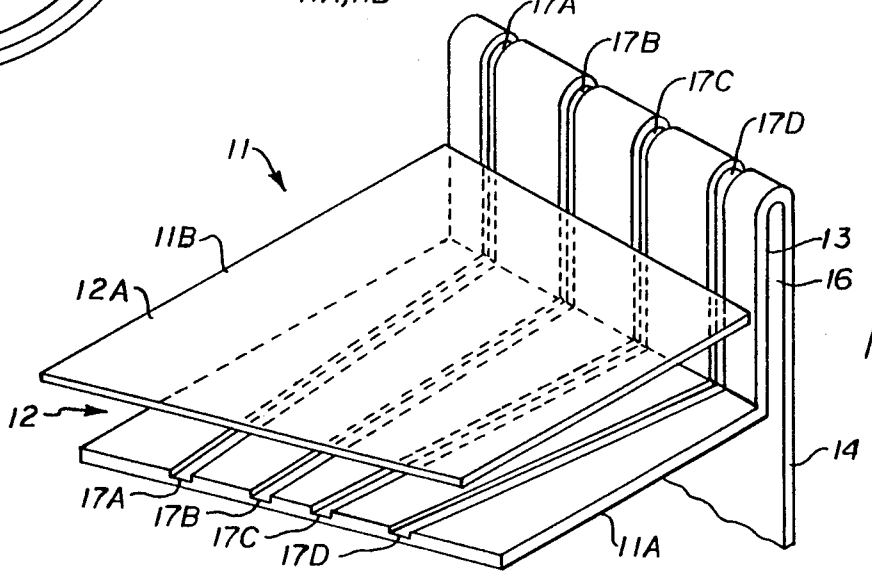
FIG. 6 is a transverse cross section through the support member showing the aerodynamic toy apparatus in the extended position.

As best seen in FIGS. 5, and 6, the support member 11 may be of sandwich construction having a bottom plate 11A and a mating top plate 11B which are sonically welded together to enclose cable channels (described hereinafter). A series of channels or grooves 17A–17D are formed in the surface of the bottom plate 11B and extend over the sides and top of vertical portions 13 and 14 and then the length of the horizontal portion 12 converging toward the cup-like shroud portion 15B of the bottom plate 11B and partially across the top of the cup-like shroud portion 15B. The top surface of the cup shaped portion 15B has an aperture 18 therethrough at the ends of the grooves 17A–17D.

After cables are placed in the channels 17A–17D, as described below, the top plate 11A which has a horizontal portion 12A and a cup shaped portion 15A sized to fit on top of the corresponding horizontal portion 12B and cup shaped portion 15B of the bottom plate 11B, is sonically welded to the bottom plate 11B to enclose the grooves 17A–17D and form a rigid unitary structure having internal cable channels running therethrough.

Referring again to FIG. 3, a spinner element S having turbine-like blades B, rotatably mounted on a shaft may be secured to the top surface of the cup-like shroud portion 15. The spinner element will rotate as the vehicle moves.

It should be understood that the sandwich construction is described and illustrated only as an example of a method for enclosing the cables, and various other methods may be incorporated without departing from the scope of the invention.

A housing 19 on the vehicle interior side of the second vertical portion 13 contains a series of small drums 20A–20D over which cables 21A–21D are wound. The drums 20A–20D are rotatably mounted on a shaft 22 and are connected to torsion springs 23A–23D. One end of cables 21A and 21D is connected to a control handle 24 which is gripped by the operator, and one end of cables 21B and 21C are connected to control rings 25A and 25B, each of which receive a finger of the operator. The springs 23A–23D maintain the handle 24 and control rings 25A and 25B in a normally retracted position closely adjacent the housing 19. Cables 21A and 21D extend through the grooves 17A and 17D and outwardly through the aperture 18 in the cup shaped portion 15B. Similarly, cables 21B and 21C extend through the grooves 17B and 17C and outwardly through the aperture 18 in the cup shaped portion 15B. A pivot arm 26 is pivotally connected to ears 27 on the interior surface of the cup-like shroud portion 15B adjacent the aperture 18.

Figure 7:
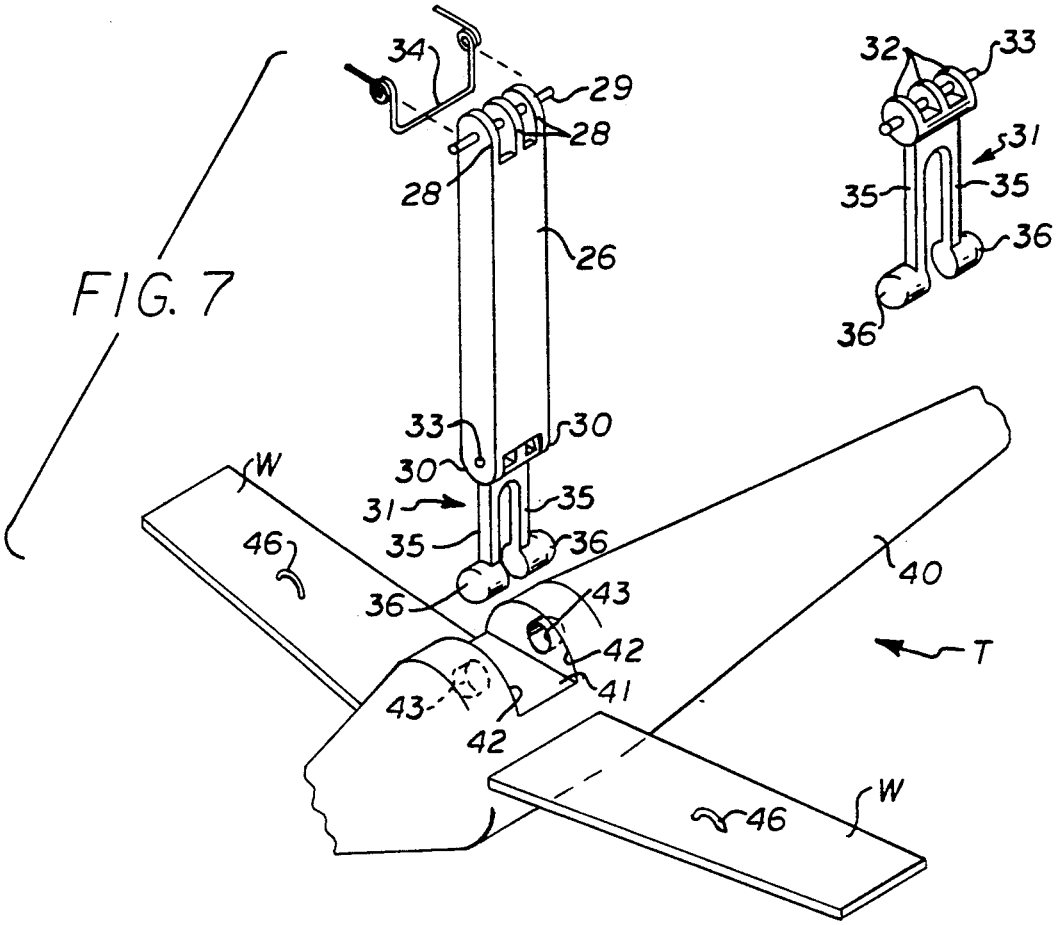
FIG. 7 is an exploded isometric view of a portion of the aerodynamic toy apparatus showing the pivotal connection apparatus.
Figure 8:
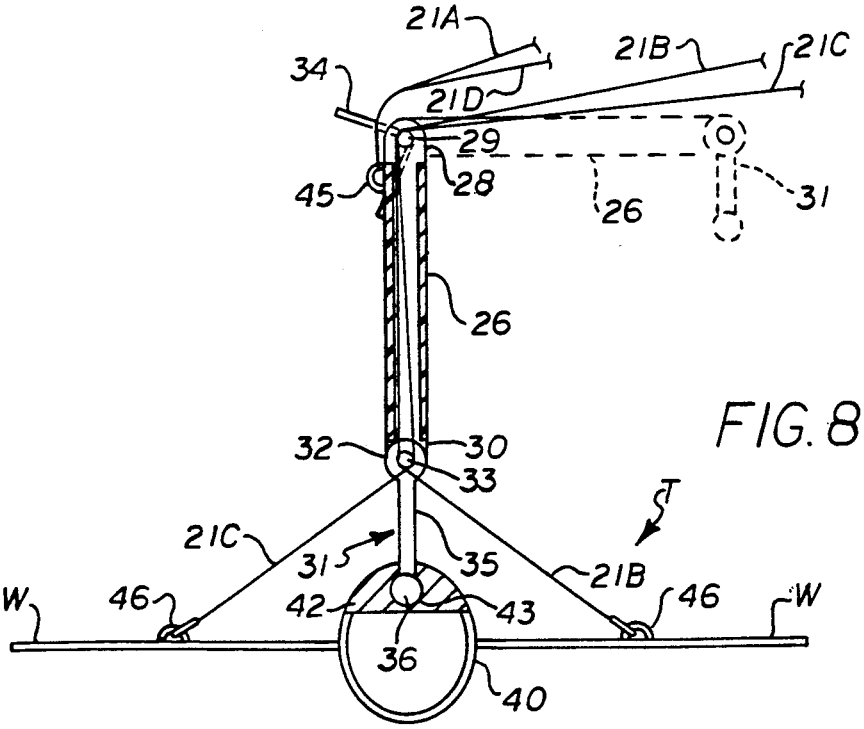
FIG. 8 is a cross section through a portion of the aerodynamic toy apparatus showing the pivotal connection apparatus and cable arrangement.

Referring additionally to FIGS. 7 and 8, the pivot arm 26 is a hollow generally rectangular member having a three ears 28 at its upper end which slidably receive a pin 29/to pivotally connect the arm between the ears 27 of the cup-like shroud portion 15B. A pair of ears 30 are formed on the lower end of the pivot arm 26. A connecting arm member 31 is pivotally connected between the ears 30 at the lower end of the pivot arm 26. The connecting arm 31 has three ears 32 at its upper end which slidably receive a pin 33 to pivotally connect the arm between the ears 30 of the pivot arm 26. When pinned together, the three ears 28 at the upper end and three ears 32 at the lower end of the pivot arm 26 serve to keep the cables separated, as described below. A torsion spring 34 is mounted on the pin 29 at the upper end of the pivot arm 26 to normally urge the pivot arm 26 upwardly toward the interior of the cup-like shroud portion 15B in a generally horizontal position, as seen in dotted line in FIGS. 3 and 8.

The connecting arm 31 has a pair of opposed depending leg members 35 which have opposed outwardly rounded protrusions or beads 36. The connecting arm 31 is formed of rigid resilient material such that the lower ends of the legs 35 may be squeezed together and when released will expand back to their original position. Thus, the beads 36 of legs 35 can be snap fitted into a mating cavity.

An aerodynamically driven toy member 40 is releasably connected to the lower end of the connecting arm 31. As best seen in FIGS. 7 and 8, the toy member 40 has an opening 41 with opposed side walls 42 each having a hole or a rounded cavity 43 dimensioned to receive the protrusions or beads 36 of the leg members 35. The spacing of the side walls 42 is such that the legs 35 may be squeezed together and pressed into the opening 41 and then released to expand the beads 36 of legs 35 into the cavities 43. Thus, the toy member 40 is pivotally connected via the beads 36 to the lower end of the conncting arm 31 to pivot relative thereto.

In the illustrated example, the toy member 40 is shown as an airplane having a rotatable propeller 44, however, it should be understood that a variety of toy members of various shapes and designs may be connected to the lower end of the connecting arm 31.

The outer end of cables 21A and 21D extend from the grooves 17A and 17D and downwardly through the aperture 18 in the cup shaped portion 15B and are connected by suitable fasteners to a ring 45 formed on the exterior of the pivot arm 26 below its upper pivot point (pin 29). Cables 21B and 21C extend from the grooves 17B and 17C, over the pivot pin 29, downwardly through pivot arm 26, and then outwardly between the ears 32. The outer end of cables 21B and 21C are connected by suitable fasteners to a ring 46 formed on the wings W of the airplane toy 40.

OPERATION

To install the aerodynamic toy apparatus 10, the rear window of the vehicle is rolled down a short distance and the slot 16 of the support portion 12, is placed over the top edge of the window glass with the vertical portions 13 and 14 on opposed sides of the glass and the housing 19 disposed on the inside of the vehicle. The rear window is then rolled up as far as possible to firmly secure the toy 10 in place. The cup-like shroud portion 15 is thus positioned outwardly a distance from the side of the vehicle.

The drums 20A–20D, biased by springs 23A–23D, normally maintain the control handle 24 and rings 25B and 25C at the ends of cables 21A–21D in a retracted position closely adjacent the housing 19. The spring 34 mounted on the pin 29 at the upper end of the pivot arm 26 normally maintains the pivot arm in a generally horizontal retracted postion in the interior of the areodynamic cup-like shroud portion 15B. In the retracted position, the toy 40 attached by the connecting arm 31 to the lower end of the pivot arm 26 is contained within the cup-like shroud 15.

When the rings 25B and 25C are placed on the fingers of the operator, and the rings and control handle 24 are pulled outwardly from the housing 19, the cables 21A–21D are pulled inwardly toward the interior of the vehicle. The cables 21A and 21D pivot the lower end of the pivot arm 26 downward about the pin 29 into a generally vertical extended position. The toy 40 attached by the connecting arm 31 at the lower end of the pivot arm 26 is then exposed beneath the bottom of the shroud 15. The air currents cause the spinner S atop the cup-like shroud to spin when the vehicle is moving. In the embodiment of the airplane, the air currents cause the propeller 44 to spin.

When the rings 25B and 25C are moved independently by the fingers of the operator, the cables 21B and 21C will pivot the wings W about the beaded connection of the connector member 31 to simulate banking or other flying maneuvers.

When the rings 25B and 25C and control handle 24 are moved inwardly toward the housing 19, the drums 20A–20D, biased by springs 23A–23D, retract the cables 21A–21D and the spring 34 at the upper end of the pivot arm 26 pivots the pivot arm back into the generally horizontal retracted postion within the interior of the areodynamic cup-like shroud portion 15B and the toy 40 is contained within the cup-like shroud 15.

While this invention has been described fully and completely with special emphasis upon a preferred embodiment, it should be understood that within the scope of the appended claims the invention may be practiced otherwise than as specifically described herein.

We claim:

1. An aerodynamic toy apparatus comprising;

a support member having one end configured to be removably installed on a motor vehicle and an aerodynamic shroud portion at an opposed end spaced a distance outward from the vehicle, an articulated toy member movably connected at said opposed end and movable between a retracted position within said shroud and an extended position outwardly of said shroud to be acted upon by air currents as the vehicle moves, manual manipulating means on said support member operatively connected with said articulated toy member and including operator control means disposed at said one end within the interior of the vehicle for moving said articulated toy member between the retracted and extended positions, whereby said articulated toy member is manipulated by a person from the interior of the vehicle.

2. An aerodynamic toy apparatus according to claim 1 wherein said support member one end is configured to be removably installed on a roll-up window of a motor vehicle.

3. An aerodynamic toy apparatus according to claim 1 wherein said support member is a rigid generally rectangular configuration.

4. An aerodynamic toy apparatus according to claim 1 including a spinner element rotatably mounted on said support member to rotate relative thereto upon passing through the air as the vehicle moves.

5. An aerodynamic toy apparatus according to claim 1 wherein said support member aerodynamic shroud portion is configured to provide minimum wind resistance and has a generally concave cavity to receive and substantially shield said articulated toy member from air currents in the retracted position.

6. An aerodynamic toy apparatus according to claim 1 wherein said operator control means includes pivot means for moving said articulated toy member between the retracted and extended positions, and secondary manipulating means for further manipulating said articulated toy member in additional movements after it has been moved to the extended position.

7. An aerodynamic toy apparatus according to claim 6 in which said articulated toy member is releasably and pivotally connected to said pivot means.

8. An aerodynamic toy apparatus according to claim 1 including spring biased retraction means on said support member operatively connected with said operator control means and said manipulating means to normally maintain said articulated toy member in the retracted position within said shroud.

9. An aerodynamic toy apparatus according to claim 1 wherein said operator control means includes cable means and pivot means operatively connected with said manual manipulating means for pivotally moving said articulated toy member between the retracted and extended positions.

10. An aerodynamic toy apparatus according to claim 9 wherein said cable means is at least partially enclosed within said support member.

11. An aerodynamic toy apparatus according to claim 1 wherein said operator control means includes first cable means and pivot means operatively connected with said manual manipulating means for pivotally moving said articulated toy member between the retracted and extended positions, and second cable means operatively connected with said articulated toy member and with secondary manipulating means for further manipulating said articulated toy member in additional movements after it has been moved to the extended position.

12. An aerodynamic toy apparatus according to claim 1 in which;

said maugual manipulating means comprises a handle member to receive the hand of the operator, cable means connected at one end to said handle member, and pivot means operatively connected at another end of said cable means for pivotally moving said articulated toy member between the retracted and extended positions.

13. An aerodynamic toy apparatus according to claim 12 including spring biased retraction means on said support member operatively connected with said pivot member to normally maintain said articulated toy member in the retracted position within said shroud.

14. An aerodynamic toy apparatus according to claim 12 including spring biased retraction means on said support member operatively connected with said cable means to normally maintain said handle member in a retracted position closely adjacent said support member.

15. An aerodynamic toy apparatus according to claim 14 including drum means rotatably mounted on said support member and operatively connected with said cable means and said spring biased retraction means to normally maintain said handle member in a retracted position closely adjacent said support member.

16. An aerodynamic toy apparatus according to claim 12 including;

secondary manipulating means associated with said handle member to receive at least one finger of the operator, second cable means operatively operatively connected at one end with said articulated toy member and at another end with secondary manipulating means for further manipulating said articulated toy member in additional movements after it has been moved to the extended position.

17. An aerodynamic toy apparatus according to claim 16 including spring biased retraction means on said support member operatively connected with said cable means and said second cable means to normally maintain said handle member and said secondary manipulating means in a retracted position closely adjacent said support member.

18. An aerodynamic toy apparatus according to claim 17 including drum means rotatably mounted on said support member and operatively connected with said cable means and said second cable means and said spring biased retraction means to normally maintain said handle member and said secondary manipulating means in a retracted position closely adjacent said support member.

* * * * *